US005131600A

United States Patent [19]

Klimpel et al.

[11] Patent Number: 5,131,600

[45] Date of Patent: Jul. 21, 1992

[54] ALKANOL AMINE GRINDING AIDS

[75] Inventors: Richard R. Klimpel, Midland; Donald E. Leonard, Shepherd, both of Mich.; Basil S. Fee, Ontario, Canada

[73] Assignee: The Dow Chemical Company, Midland, Mich.

[21] Appl. No.: 567,214

[22] Filed: Aug. 14, 1990

Related U.S. Application Data

[63] Continuation-in-part of Ser. No. 484,012, Feb. 23, 1990, Pat. No. 5,057,279, which is a continuation-in-part of Ser. No. 336,196, Apr. 11, 1989, abandoned, which is a continuation-in-part of Ser. No. 310,271, Feb. 13, 1989, abandoned.

[51] Int. Cl.[5] ..... B02C 23/06

[52] U.S. Cl. ..... 241/16; 241/24

[58] Field of Search ..... 241/16, 24

[56] References Cited

U.S. PATENT DOCUMENTS

| | | | |
|---|---|---|---|
| 1,102,874 | 7/1914 | Chapman | 209/166 |
| 2,014,405 | 9/1935 | Weed | 209/166 |
| 2,031,621 | 2/1936 | Tucker | 106/727 |
| 2,074,699 | 3/1937 | Lenner et al. | 209/166 |
| 2,141,571 | 12/1938 | Kennedy | 241/16 |
| 2,173,909 | 9/1939 | Kritchevsky | 209/166 |
| 2,182,845 | 12/1939 | Harris | 209/166 |
| 2,335,485 | 11/1943 | Christmann | 209/166 |
| 2,377,129 | 5/1945 | Christmann et al. | 209/166 |
| 2,383,891 | 8/1945 | Scripture | 106/727 |
| 2,385,819 | 10/1945 | Lamb | 209/166 |
| 3,068,110 | 12/1962 | Fagerholt | 241/16 |
| 3,329,517 | 7/1967 | Dodson | 106/727 |
| 3,443,976 | 5/1969 | Dodson | 241/16 |
| 3,607,326 | 9/1971 | Serafin | 209/166 |
| 4,081,363 | 3/1978 | Grayson | 209/166 |
| 4,110,207 | 8/1978 | Wang et al. | 209/166 |
| 4,139,482 | 2/1979 | Holme | 252/61 |
| 4,158,623 | 6/1979 | Wang et al. | 209/166 |
| 4,162,044 | 7/1979 | Manfroy | 241/16 |
| 4,162,045 | 6/1979 | Katzer | 241/16 |
| 4,172,029 | 10/1979 | Hefner, Jr. | 209/166 |
| 4,274,599 | 6/1981 | Manfroy | 241/16 |
| 4,276,156 | 6/1981 | Hefner, Jr. | 209/166 |
| 4,386,963 | 6/1983 | Lange | 241/16 |
| 4,507,198 | 3/1985 | Unger et al. | 209/166 |

FOREIGN PATENT DOCUMENTS

| | | | |
|---|---|---|---|
| 378252 | 8/1971 | U.S.S.R. | 209/166 |
| 649469 | 6/1977 | U.S.S.R. | 209/166 |
| 1050751 | 5/1982 | U.S.S.R. | 209/166 |
| 1058136 | 4/1985 | U.S.S.R. | 209/166 |
| 1356915 | 6/1974 | United Kingdom | 209/166 |

*Primary Examiner*—Stanley S. Silverman
*Assistant Examiner*—Thomas M. Lithgow

[57] ABSTRACT

The efficiency of grinding of silica-containing solids such as mineral ores is improved by the addition of alkanol amines as a grinding aid. Examples of useful amines include diethanol amine, ethanol amine, triethanol amine and mixtures thereof.

8 Claims, No Drawings

ALKANOL AMINE GRINDING AIDS

CROSS-REFERENCE TO RELATED APPLICATIONS

This is a continuation-in-part of co-pending application Ser. No. 484,012, filed Feb. 23, 1990, (now U.S. Pat. No. 5,057,279) which is a continuation-in-part of application Ser. No. 336,196 filed Apr. 11, 1989, now abandoned, which in a continuation-in-part of application Ser. No. 310,271 filed Feb. 13, 1989, now abandoned.

BACKGROUND OF THE INVENTION

This invention is related to wet-grinding of particulate material containing silica or siliceous gangue in the presence of a grinding aid.

Reduction of the particle size of various mineral ores is an important step in various processes. For example, mineral ores are frequently subjected to particle size reduction prior to further processing steps such as froth flotation, mechanical separation and pelletization. Grinding operations are usually carried out in mills such as ball, bead, rod or pebble mills, depending upon the degree of size reduction required. Autogeneous grinding may also be employed or a combination of media and autogeneous milling referred to as semi-autogeneous grinding may be used.

In the processing of ores, an essential step is the size reduction or comminution of the ore to the size at which valuable metal grains are released from the gangue matrix. As the quality of ore available decreases, the degree of comminution necessary to release the valuables from the gangue also increases. This in turn increases the grinding cost to process the ore. Since the grinding process is quite energy intensive, the increases in energy costs coupled with the need for additional grinding has resulted in grinding costs being a significant portion of the cost of processing minerals and coals.

The amount of breakage per unit time (breakage kinetics) and mass transfer of grinding are frequently controlled by the addition and removal of water to the mill. Water is an excellent medium for grinding due to its high polarity. When the mass transport of the slurry through the mill decreases, corrective action is taken either by decreasing the feed rate of solids and/or increasing the amount of water entering the mill. These actions avoid overloading of the mill, but decrease efficiency since fewer solids are ground per unit time.

Various chemical agents that act as grinding aids have been employed in efforts to increase wet grinding efficiencies and economics. One way in which grinding efficiencies may be improved is by modifying the viscosity of a slurry of a given weight percent solids. These methods have had varying levels of success in certain systems. However, since grinding is a preliminary step in processing, it is important that grinding aids not have a negative impact on subsequent operations. Various dispersants and surfactants such as anionic polyelectrolytes, polysiloxane, organosilicones, lycols, certain amines, graphite and non-polar liquids have all been utilized with varying degrees of success. However, no method of choosing the best surfactant for a given processing scheme exists and trial and error is often used to find the most efficient system.

However, certain conditions have been found to be required for grinding aids to act as suitable viscosity control agents. These conditions include:

(1) the chemical must adsorb on enough of the solid surfaces available so as to affect slurry viscosity:
(2) the unmodified slurry viscosity must be high enough so that use of the grinding aid can help reduce or control slurry viscosity;
(3) the grinding aid must be consistent in its ability to lower viscosity as a function of the chemical concentration, pH, water quality and amount of shear present;
(4) the chemical must be non-toxic and degradable;
(5) the grinding aid must not adversely affect downstream operations; and
(6) the use of the grinding aid must be economically viable in grinding operations.

Thus, it is desirable to find grinding aids which fulfill these conditions.

SUMMARY OF THE INVENTION

The present invention is a process for the wet grinding of silica- or siliceous gangue-containing solids, which solids comprise ores containing mineral values, comprising carrying out the grinding operation in the presence of a liquid medium and at least one alkanol amine dispersible in the liquid medium. The alkanol amine is used in an amount effective to provide increased grinding efficiency.

The grinding process of this invention is useful in the grinding of solids containing silica or siliceous gangue. It is surprising that the use of a small amount of an alkanol amine results in more efficient grinding. It has also been found that the alkanol amine grinding aid does not detrimentally affect further processing of the treated ores.

DETAILED DESCRIPTION OF ILLUSTRATIVE EMBODIMENTS

The method of the present invention is preferably carried out in the presence of a polar liquid medium in which the grinding aid is sufficiently dispersible to produce an improvement in grinding efficiency. It may be feasible to use a liquid which is not a solvent for the grinding aid so long as a solvent or dispersant for the grinding aid is also present. Water is the preferred medium. The concentration of the solids to be ground in the liquid medium may vary within wide limits. It is usual to operate grinding operations using a slurry within the range of solid content of from about 40 to about 60 volume percent. The solid content is preferably from about 40 to about 55, more preferably from about 65 to about 88 and most preferably from about 44 to about 53 volume percent of the slurry. As will be recognized by one skilled in the art and discussed further below, the volume percent solids of the slurry at which the grinding aid of the present invention will be most effective is dependent on a number of factors including the identity of the solids in the slurry and the amount of silica of siliceous gangue included with the solids.

It is a particular feature of the present invention that the solids to be ground contain silica or siliceous gangue. Silica and/or siliceous gangue is often present in mineral ores, including oxide ores, sulfide ores and noble metal ores. Without wishing to be bound by any theory, it is assumed that the grinding aids of the present invention are effective due to interactions with the silica or siliceous gangue present in the solids. Thus, the invention is most effective in the grinding of solids containing relatively large amounts of silica. By relatively large amounts of silica, it is meant that the solids are at least about 5 weight percent silica or siliceous gangue, more preferably at least about 20 weight percent silica or siliceous gangue and most preferably at least about 40 weight percent silica or siliceous gangue. The upper limit on the amount of silica gangue is, in a practical sense, that amount which leaves a sufficient amount of valuable solids present for the grinding to be economically feasible. This amount varies depending on the economic value of the solids to be recovered.

Various silica- or siliceous gangue-containing solids may be ground by the process of the present invention. These solids include natural sands such as oil sands, tar sands and oil shale and mineral ores including oxide, sulfides and noble metal ores.

Non-limiting examples of silica-containing oxide ores which may be ground using the practice of this invention preferably include iron oxides, nickel oxides, phosphorus oxides, copper oxides and titanium oxides. Other types of oxygen-containing minerals having silica gangue which may be treated using the practice of this invention include carbonates such as calcite or dolomite and hydroxides such as bauxite. Specific non-limiting examples of silica-containing oxide ores which may be ground using the process of this invention are ores including cassiterite, hematite, cuprite, vallerite, calcite, talc, kaolin, apatite, dolomite. bauxite, spinel, corundum, laterite, azurite, rutile, magnetite, columbite, ilmenite, smithsonite, anglesite, scheelite, chromite, cerussite, pyrolusite. malachite, chrysocolla, zincite, massicot, bixbyite, anatase, brookite, tungstite, uraninite, gummite, brucite, manganite, psilomelane, goethite, limonite, chrysoberyl, microlite, tantalite and samarskite.

Various silica-containing sulfide ores may also be ground by the practice of this invention. Non-limiting examples of sulfide ores which may be ground by the process of this invention include those containing chalcopyrite, chalcocite, galena, pyrite, sphalerite and pentlandite.

Grinding efficiency may be determined from the amount of particulate solid of particle size less than 325 mesh (44 micrometers) U. S. Standard, that can be formed from a given liquid slurry of constant volume of liquid and solids using the same energy input. Normally, as the weight percent of ore solids in this slurry is increased, the grinding efficiency of the grinding medium is decreased. Thus, it is critical in the practice of this invention that the amount of grinding aid used is sufficient to reverse the trend towards a lower grinding efficiency as weight percent concentration of solids in the slurry is increased.

Alkanol amines are useful in this invention as grinding aids for grinding silica-containing solids. It is preferred that the alkanol amines used in the practice of this invention are lower alkanol amines having from about one to about six carbon atoms. In a preferred embodiment, the alkanol amines correspond to the formula $$(R)_xNH_{(3-x)}$$

wherein x is from one to three and R is separately in each occurrence a $C_{1-6}$ alkanol which may be branched or linear. In an even more preferred embodiment, the alkanol amine is ethanol amine, diethanol amine, triethanol amine, propanol amine. isopropanol amine, butanol amine, isobutanol amine or mixtures thereof. It is most preferred that the alkanol is diethanol amine.

The alkanol amines useful in the practice of this invention are available commercially. As will be recognized by one skilled in the art, commercially available alkanol amines will have varying degrees of purity. For example, commercially available diethanol amine may contain varying amounts of ethanol amine and/or triethanol amine. Such alkanol amines are suitable in the practice of the present invention.

The amount of grinding aid effective to increase the grinding efficiency will vary depending on factors unique to each solid being ground. A very significant factor is the amount of silica contained in the solid to be ground. As discussed above, it is assumed that the grinding aids of the present invention function by interacting with the silica present with the solid. Thus, the amount of grinding aid needed is related to the amount of silica present.

Additional factors to be considered include mill type, slurry volume, number and size of grinding media, raw ore or solid particle size, mill rpm and solid properties. These factors affect the "selection" function which describes the probability that a particle of any particular size will be broken in a given unit of time. The properties unique to each solid to be ground affect the "distribution function", that is, the number and size distribution of fragments into which a particle subdivide when it is broken. Measurement of the number and size distribution of fragments after grinding will allow the calculation of the effect of the aid on the selection and distribution functions which will indicate the effectiveness of the grinding aid added. Further reference to the use of selection and distribution functions in determining the effect of grinding aid materials in wet grinding processes can be found in Klimpel. R. R., "Slurry Rheology Influence on the Performance of Mineral/Coal Grinding Circuits", Parts I and II, *Mining Engineering*, Vol. 34, pp. 1665–1668 (1982) and Vol. 35, pp. 21–26 (1983);

Austin, L. G., Klimpel. R. R., and Luckic, P. T., *Process Engineering of Size Reduction*, Society of Mining Engineers, Littleton, Colo. (1984).

The liquid slurry preferably contains grinding media such as those employed in large ore grinding mills such as ball, bead, rod or pebble mills. The media are generally of a sufficient size so that they do not contribute to the inherent viscosity of the slurry. These mills are distinct from those mills in which solids are ground to an extreme fineness such as is the case with paint pigments, for example.

Typically, the effective amount of grinding aid ranges from about 10 grams per ton of dry solid up to about 3000 grams per ton of dry solid. The maximum amount of grinding aid used is typically limited by economic constraints. Preferably, the amount of grinding aid used ranges from about 100 grams per ton of dry solids up to about 1000 grams per ton of dry solids. The optimum amount of grinding aid from an economic viewpoint will depend on the particular material to be ground and various other factors as discussed above.

The grinding process of the present invention may be done at the natural pH of the slurry or at a modified pH. In determining optimum pH, one skilled in the art will recognize the need to consider subsequent processing steps and how pH modifiers might affect those steps.

The following examples are provided to illustrate the invention and should not be interpreted as limiting it in any way. Unless stated otherwise, all parts and percentages are by weight.

EXAMPLE 1

Grinding of Silica-Containing Iron Ore

Low grade taconite iron ore containing about 44 percent $SiO_2$ from northern Minnesota is sized to 100 percent less than 10 mesh (2000 micrometers) U. S. Standard using jaw crushers and screens. Individual 1000 g samples are prepared using appropriate sample splitting techniques to maintain uniform mixing of the samples. A laboratory batch ball mill of 20.3 cm diameter and 30.5 cm length containing 120 2.54 cm balls is used as the grinding device. The mill is rotated at 60 rpm for 60 minutes. In each run the slurry volume is maintained at 950 cubic centimeters with the solids content being varied as shown in Table 1 below. The results of each run are wet screened using a 325 mesh (45 micrometers) U. S. Standard screen to determine the total weight of the solids ground finer than this size. Results are shown in Table I below.

TABLE I

| Run | Dry Wt. of Ore (g) | Wt. % Solids | Vol. % Solids | Chemical Additive | Dosage (g/ton) | Wt. % −325 Mesh | Grams of −325 U.S. Mesh |
|---|---|---|---|---|---|---|---|
| 1① | 1373 | 72 | 43.8 | None | — | 73.0 | 1002 |
| 2 | 1373 | 72 | 43.8 | Diethanol amine | 270 | 72.6 | 997 |
| 3① | 1535 | 76 | 49.0 | None | — | 65.7 | 1009 |
| 4 | 1535 | 76 | 49.0 | Diethanol amine | 270 | 66.1 | 1015 |
| 5① | 1726 | 80 | 55.2 | None | — | 60.0 | 1036 |
| 6 | 1726 | 80 | 55.2 | Diethanol amine | 135 | 60.5 | 1044 |
| 7 | 1726 | 80 | 55.2 | Diethanol amine | 270 | 61.1 | 1055 |
| 8 | 1726 | 80 | 55.2 | Diethanol amine | 450 | 61.8 | 1067 |
| 9 | 1726 | 80 | 55.2 | Diethanol amine | 900 | 62.3 | 1075 |
| 10 | 1726 | 80 | 55.2 | Diethanol amine | 2000 | 62.7 | 1082 |
| 11 | 1726 | 80 | 55.2 | Ethanol amine | 270 | 61.5 | 1062 |
| 12 | 1726 | 80 | 55.2 | Triethanol amine | 270 | 61.0 | 1053 |
| 13 | 1726 | 80 | 552. | Isopropanol amine | 270 | 60.8 | 1050 |
| 14 | 1726 | 80 | 55.2 | Hexanol amine | 270 | 60.4 | 1042 |
| 15 | 1726 | 80 | 55.2 | Decanol amine | 270 | 60.1 | 1037 |
| 16① | 1828 | 82 | 58.0 | None | — | 53.5 | 978 |
| 17 | 1828 | 82 | 58.0 | Decanol amine | 270 | 55.1 | 1007 |
| 18① | 2046 | 86 | 64.9 | None | — | 39.3 | 804 |
| 19 | 2046 | 86 | 64.9 | Decanol amine | 270 | 38.0 | 778 |

①Not an embodiment of the invention.

The data in Table I above demonstrates the effectiveness of the present invention. In this particular ore, the grinding aid is most effective with slurries having weight percent solids greater than 72 and less than 86. The grinding aid is more effective as the dosage is increased although as is recognized by those skilled in the art, the dosage most useful in an industrial setting will depend on a balance between cost and effectiveness.

EXAMPLE 2

Grinding of Silica-Containing Gold Ore

The procedure outlined in Example 1 is followed with the exception that gold ore containing about 95 weight percent $SiO_2$ is used rather than the iron ore and the grinding time is 120 minutes. The results obtained are shown in Table 11 below.

TABLE II

| Run | Dry Wt. of Ore (g) | Wt. % Solids | Vol. % Solids | Chemical Additive | Dosage (g/ton) | Wt. % −325 Mesh | Grams of −325 U.S. Mesh |
|---|---|---|---|---|---|---|---|
| 1① | 731 | 52 | 29.0 | None | — | 87.7 | 641 |
| 2 | 731 | 52 | 29.0 | Diethanol amine | 270 | 89.1 | 651 |
| 3① | 910 | 60 | 36.1 | None | — | 84.5 | 769 |
| 4 | 910 | 60 | 36.1 | Diethanol amine | 270 | 84.7 | 771 |
| 5① | 1011 | 64 | 40.1 | None | — | 78.8 | 796 |
| 6 | 1011 | 64 | 40.1 | Diethanol amine | 270 | 78.4 | 792 |
| 7① | 1120 | 68 | 44.5 | None | — | 70.9 | 794 |
| 8 | 1120 | 68 | 44.5 | Diethanol amine | 270 | 72.1 | 808 |
| 9① | 1240 | 72 | 50.8 | None | — | 63.9 | 792 |
| 10 | 1240 | 72 | 50.8 | Diethanol amine | 135 | 65.1 | 807 |
| 11 | 1240 | 72 | 50.8 | Diethanol amine | 270 | 66.6 | 826 |
| 12 | 1240 | 72 | 50.8 | Diethanol amine | 450 | 67.3 | 835 |
| 13 | 1240 | 72 | 50.8 | Diethanol amine | 900 | 68.4 | 848 |
| 14① | 1370 | 76 | 54.4 | None | — | 55.2 | 756 |
| 15 | 1370 | 76 | 54.4 | Diethanol amine | 270 | 59.0 | 808 |
| 16 | 1370 | 76 | 54.4 | Triethanol amine | 270 | 58.7 | 804 |
| 17 | 1370 | 76 | 54.4 | Isopropanol amine | 270 | 58.3 | 799 |
| 18 | 1370 | 76 | 54.4 | Monoethanol amine | 270 | 59.2 | 811 |
| 19① | 1514 | 80 | 60.2 | None | — | 43.5 | 659 |
| 20 | 1514 | 80 | 60.2 | Diethanol amine | 270 | 47.5 | 719 |

①Not an embodiment of the invention.

The data in Table II shows the effectiveness of the present invention in grinding a noble metal ore having a high silica content. The grinding aid is most effective in this ore in slurries having the higher solids contents.

EXAMPLE 3

Grinding of Silica-Containing Copper Sulfide Ore

The procedure outlined in Example 1 is followed with the exception that copper sulfide ore containing about 14 weight percent silica and siliceous gangue is used rather than the iron ore and the grinding time is 30 minutes. The results obtained are shown in Table III below.

TABLE III

| Run | Dry Wt. of Ore (g) | Wt. % Solids | Vol. % Solids | Chemical Additive | Dosage (g/ton) | Wt. % −325 Mesh | Grams of −325 U.S. Mesh |
|---|---|---|---|---|---|---|---|
| 1① | 1073 | 66 | 41.8 | None | — | 50.1 | 538 |
| 2 | 1073 | 66 | 41.8 | Diethanol amine | 270 | 50.3 | 540 |
| 3① | 1130 | 68 | 44.0 | None | — | 50.5 | 571 |
| 4 | 1130 | 68 | 44.0 | Diethanol amine | 270 | 50.3 | 568 |
| 5① | 1251 | 72 | 48.8 | None | — | 45.6 | 570 |
| 6 | 1251 | 72 | 48.8 | Diethanol amine | 270 | 45.4 | 568 |
| 7① | 1385 | 76 | 54.0 | None | — | 38.4 | 531 |
| 8 | 1385 | 76 | 54.0 | Diethanol amine | 135 | 42.7 | 591 |
| 9 | 1385 | 76 | 54.0 | Diethanol amine | 270 | 43.1 | 597 |
| 10 | 1385 | 76 | 54.0 | Diethanol amine | 450 | 43.6 | 604 |
| 11 | 1385 | 76 | 54.0 | Diethanol amine | 900 | 44.0 | 609 |
| 12① | 1531 | 80 | 59.7 | None | — | 33.3 | 510 |
| 13 | 1531 | 80 | 59.7 | Diethanol amine | 270 | 33.8 | 517 |

① Not an embodiment of the invention.

The data in Table III shows the effectiveness of the present invention in grinding a sulfide copper ore having a low silica content. The grinding aid is most effective with the slurry having a solids content of about 76 weight percent.

What is claimed is:

1. A process for the wet grinding of silica- or siliceous gangue-containing solids which comprise ores containing mineral values, comprising carrying out the grinding operation in the presence of a sufficient amount of a liquid medium to yield a solids slurry of said silica or siliceous gangue-containing solids of about 40 to about 60 volume percent of said solids and a grinding aid consisting essentially of an amount of at least one alkanol amine dispersible in the liquid medium effective to act as a grinding aid, the alkanol amine corresponding to the formula $$(R)_xNH_{(3-x)}$$

wherein x is from one to three and R is separately in each occurrence a $C_{1-6}$ alkanol.

2. The process of claim 1 wherein the alkanol amine is used at a level of at least about 10 grams per ton of dry solids and no greater than about 3000 grams per ton of dry solids.

3. The process of claim 2 wherein the alkanol amine is used at a level of at least about 100 grams per ton of dry solids and no greater than about 1000 grams per ton of dry solids.

4. The process of claim 1 wherein the alkanol amine is selected from the group consisting of ethanol amine, diethanol amine, triethanol amine, propanol amine, isopropanol amine, butanol amine, isobutanol amine and mixtures thereof.

5. The process of claim 4 wherein the alkanol amine is diethanol amine.

6. The process of claim 1 wherein the silica- or siliceous gangue-containing solid is an oxide ore.

7. The process of claim 1 wherein the silica- or siliceous gangue-containing solid is a noble metal ore.

8. The process of claim 1 wherein the silica- or siliceous gangue-containing solid is a sulfide ore.

* * * * *